United States Patent [19]

Mikiya

[11] Patent Number: 5,058,220

[45] **Date of Patent: * Oct. 22, 1991**

[54] JET NOZZLE APPARATUS

[75] Inventor: Toshio Mikiya, Tokyo, Japan

[73] Assignee: Nikki Co., Ltd., Tokyo, Japan

[ * ] Notice: The portion of the term of this patent subsequent to Jun. 19, 2007 has been disclaimed.

[21] Appl. No.: 407,423

[22] Filed: Sep. 14, 1989

[30] Foreign Application Priority Data

Sep. 19, 1988 [JP] Japan ..... 63-122508[U]

[51] Int. Cl.[5] ..... A61H 33/02; B05B 15/00

[52] U.S. Cl. ..... 4/542; 4/615; 4/567; 239/274; 239/381

[58] Field of Search ..... 4/541, 542, 543, 544, 4/615, 492, 567, 568, 569, 570, 494, 601; 239/407, 428.5, 274, 381; 128/66

[56] References Cited

U.S. PATENT DOCUMENTS

| | | | |
|---|---|---|---|
| 2,447,123 | 8/1948 | Jones | 239/428.5 |
| 2,893,644 | 7/1959 | Holden | 239/282 |
| 3,509,584 | 9/1967 | Sable | 4/494 |
| 4,703,893 | 11/1987 | Gruber | 239/391 |
| 4,933,999 | 6/1990 | Mikiya et al. | 4/568 |

*Primary Examiner*—Henry J. Recla
*Assistant Examiner*—David J. Walczak
*Attorney, Agent, or Firm*—Nixon & Vanderhye

[57] ABSTRACT

A jet nozzle apparatus includes a hose having a faucet connection member to be connected to a faucet of a hot-water supply system or a hot-water supply unit, a mixing unit for mixing compressed hot water introduced through the hose with air, and a nozzle, connected to the hose, for forcibly jetting out a fluid mixture of hot water and air. A fluid mixture of hot water and air can be jetted out in an arbitrary direction by using the nozzle.

7 Claims, 6 Drawing Sheets

JET NOZZLE APPARATUS

BACKGROUND OF THE INVENTION

1. Field of the Invention

The present invention relates to a jet nozzle apparatus for providing massage by using hot water supplied from, e.g., a home automatic hot-water supply system.

2. Description of the Related Art

In conventional bath jet massage apparatus generally, a jet hole for a jet stream is formed in the inner wall of a bath, and a fluid mixture of hot water and air is supplied to the jet hole using a pump so as to jet out the mixture from the jet hole into the bath as a jet stream.

In the conventional jet massage apparatus, therefore, a pump must be arranged near the bath, and hence the size of the overall system is inevitably increased. Since houses are generally not equipped with such pumps, jet massage cannot be easily performed at home.

SUMMARY OF THE INVENTION

It is an object of the present invention to provide a jet nozzle apparatus which allows massage by a jet stream to be easily performed at home by using hot water supplied from an automatic hot-water supply system or an instantaneous water heater.

In order to achieve the above object, according to the present invention, there is provided a jet nozzle apparatus comprising a hose having a faucet connection member to be connected to a faucet of a hot-water supply system or a hot-water supply unit, a mixing unit for mixing compressed hot water supplied through the hose with air, and a nozzle, connected to the hose, for forcibly jetting out a fluid mixture of hot water and air.

According to the present invention, the connecting portion of the hose of the jet nozzle apparatus is connected to, e.g., a faucet for introducing hot water into a bath, and hot water is supplied from the faucet to the nozzle. Meanwhile, air taken through an air introducing hose is drawn into the nozzle by an ejector effect of the hot water supplied from the faucet so as to be mixed with the hot water in the nozzle. This fluid mixture is jetted out from a jet hole. The hot-water supply system or the hot-water supply unit is directly connected to a service water pipe, and the pressure of the service water pipe can be satisfactorily used as a pressure necessary for a jet stream, thus obtaining a jet massage effect.

According to the present invention, a nozzle case having a jet hole is designed to be connectable to a hot-water faucet through a hose, and hot water and air are mixed with each other and are jetted out from the jet hole. With this arrangement, jet massage by a jet stream can be easily performed using hot water directly supplied from an automatic hot-water supply system or an instantaneous water heater without a large unit such as a pump. Therefore, the apparatus of the present invention is very handy.

BRIEF DESCRIPTION OF THE DRAWINGS

FIGS. 1 to 6 show a jet nozzle apparatus according to an embodiment of the present invention, in which FIG. 1 is a longitudinal sectional side view of a nozzle body constituting the apparatus of the first embodiment, FIG. 2 is a longitudinal sectional right side view of the nozzle body in FIG. 1, FIG. 3 is a plan view of the nozzle body in FIG. 1, FIG. 4 is a front view showing a jet surface of a nozzle case, FIG. 5 is a perspective view showing a case wherein a hose is attached to a hot-water faucet, and FIG. 6 is a view showing a state wherein the apparatus is attached a bath inner wall;

DETAILED DESCRIPTION OF THE PREFERRED EMBODIMENTS

Figure 1:
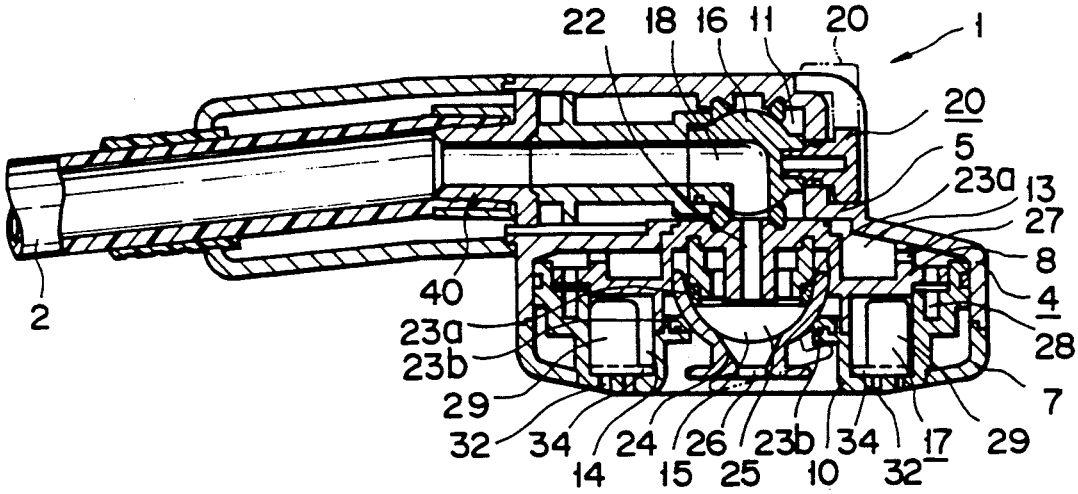
Figure 2:
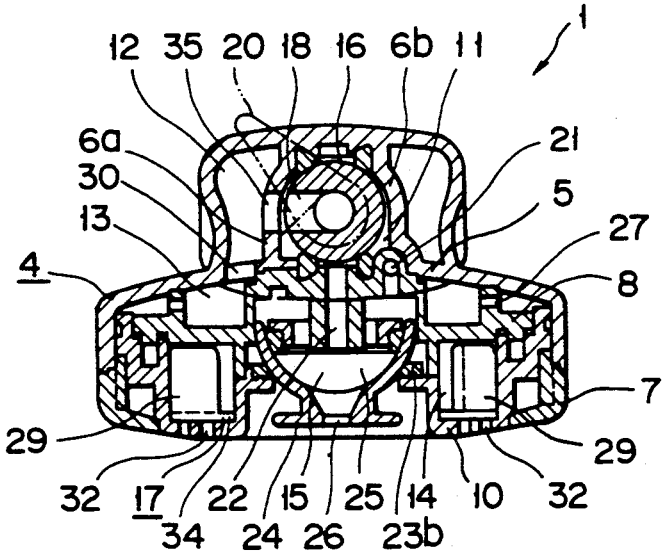
Figure 3:
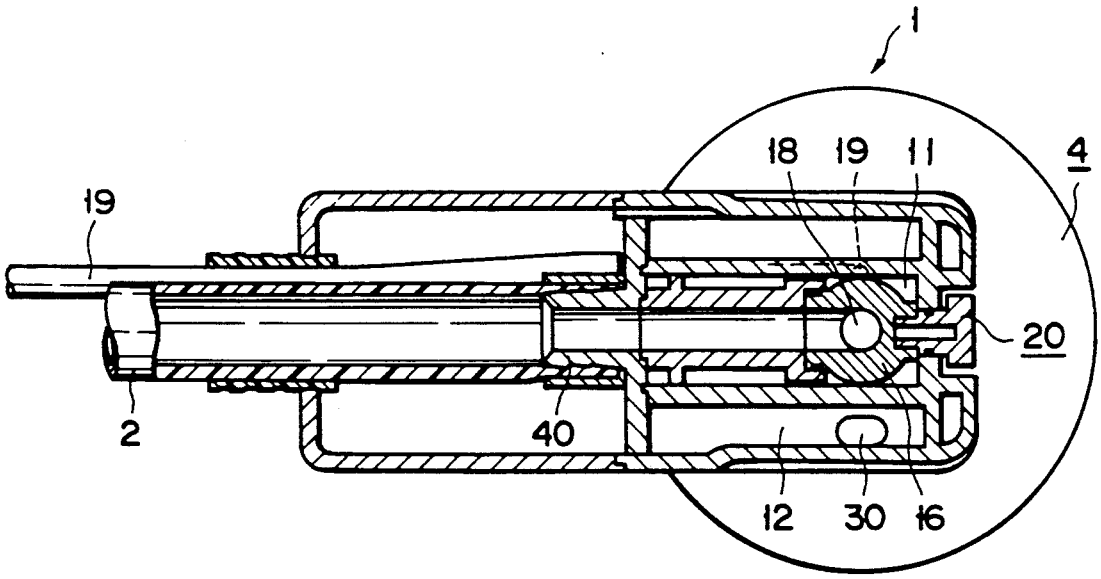
Figure 4:
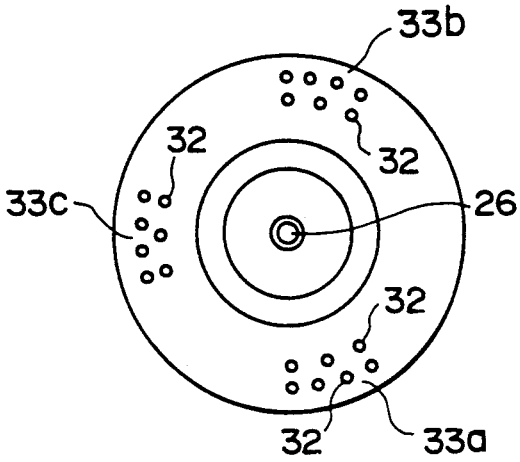

An embodiment of the present invention will be described below with reference to the accompanying drawings.

FIGS. 1 to 6 show a jet nozzle apparatus according to a first embodiment of the present invention. The jet nozzle apparatus of the present invention comprises a nozzle body 1, a hose 2, and an air introducing hose 19 as main constituent elements. One end of the hose 2 is connected to the nozzle body 1. A connecting portion which is connected to a hot-water faucet is arranged at the other end of the hose 2. The hose 19 introduces air into the nozzle body 1.

Referring to FIGS. 1 to 4, in a nozzle case 4, an intermediate partition wall 5, side partition walls 6*a* and 6*b*, a frame 7, a first partition wall 8 interposed between the wall 5 and the frame 7, and a second partition wall 10 constitute a valve chamber 11, a path space 12, a hot water inlet chamber 13, an impeller chamber 14, and an open space 15.

A switching valve 16 is housed in the valve chamber 11. An impeller 17 is rotatably housed in the impeller chamber 14. A switching path 18 having a substantially L-shaped section is formed inside the switching valve 16. In addition, a switching lever 20 for switching the flow of a fluid is coupled to the switching valve 16. A flow path 22 is formed in substantially the center of the first partition wall. The outlet side of the flow path 22 is covered with a bowl-like valve nozzle 24 slidably clamped between clamp portions 23*a* and 23*b*. A space defined between the valve nozzle 24 and the flow path 22 serves as a jet stream chamber 25.

In addition, a jet hole 26 is formed in the central portion of the valve nozzle 24. A path extending from the flow path 22 to the jet hole 26 through the jet stream chamber 25 constitutes a first path. An air introducing hole 21 is formed in the intermediate partition wall 5 as a second path having an outlet open to the first path, i.e., the jet stream chamber 25.

The impeller chamber 14 communicates with the path space 12 through paths 27 and 28 and a through hole 30. The impeller 17 housed in the impeller chamber comprises a plurality of vanes 29 (three vanes in this embodiment). Shield plates 34 are respectively fixed to two of these vanes 29. The shield plates 34 seal shower jet hole groups 33*a*, 33*b*, and 33*c* (FIG. 4) at positions where the shield plates 34 oppose the shower jet hole groups when the impeller 17 is rotated. The hole group 33*a*, 33*b*, or 33*c* consists of a plurality of shower jet holes 32 formed in a surface of the second partition wall 10, i.e., a wall portion formed on the nozzle jet surface side.

One end of the hose 2 is connected to a connecting portion 40 of the nozzle body 1 while the other end of the hose 2 constitutes a connecting portion 3 to be connected to a hot-water faucet.

An automatic hot-water supply system generally used in homes is designed to supply hot water from hot-water faucets arranged in a bath room, a kitchen, and the like. For example, an instantaneous water heater is one example of such a system. According to the present invention, the hose 2 is connected to a hot-water faucet for supplying hot water, and hot-water is directly supplied from the faucet to the nozzle body 1 through the hose 2.

Figure 5:
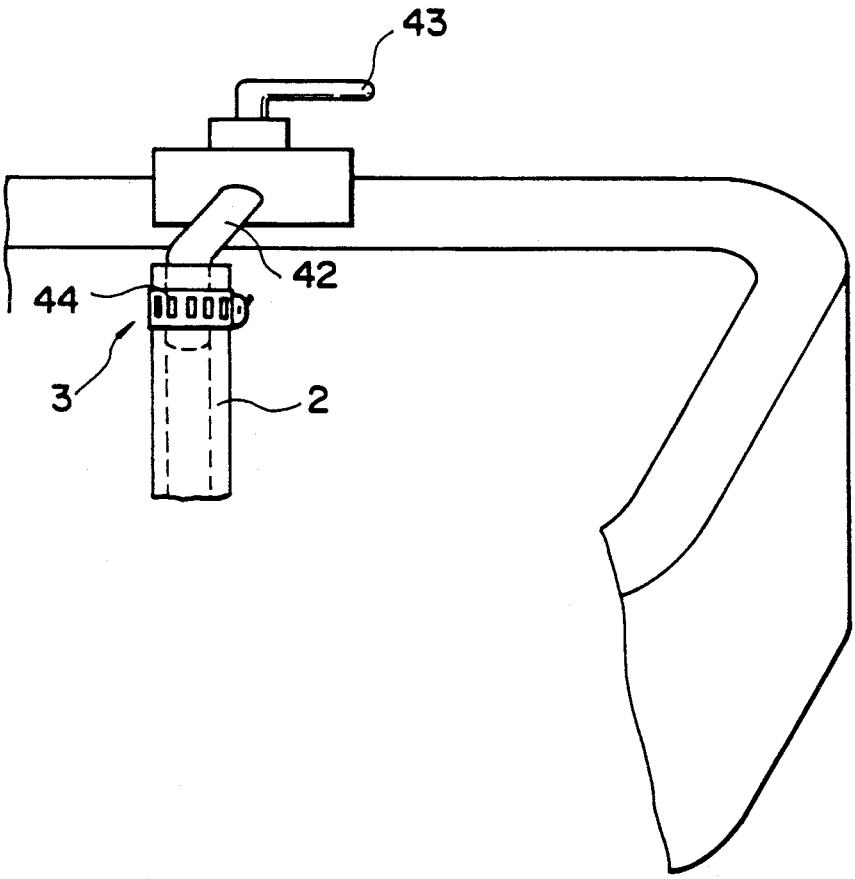

FIG. 5 shows a bath faucet widely used in general homes together with a bath. The bath includes a so-called mixing water plug (to be referred to as a faucet hereinafter) 42 for pouring hot water supplied from an automatic hot-water supply system or an instantaneous water heater. The mixing ratio of hot water and cold water can be changed by operating a lever 43 leftward or rightward. The connecting portion of the hose 2 is fitted on the faucet 42 to be connected, as shown in, e.g., FIG. 5. Various other methods of connecting the hose 2 to the faucet may be employed. For example, as shown in FIG. 5, the outer surface of the hose 2 may be clamped by a band 44. Alternatively, a quick coupling plug capable of so-called one-touch connection is attached to the faucet 42 in advance, and a socket as a counterpart of the plug is attached to the hose 2. With this arrangement, if the socket and the plug are designed to be freely connected and disconnected using a ball lock system, the hose 2 can be detachably connected to the faucet 42.

Figure 6:
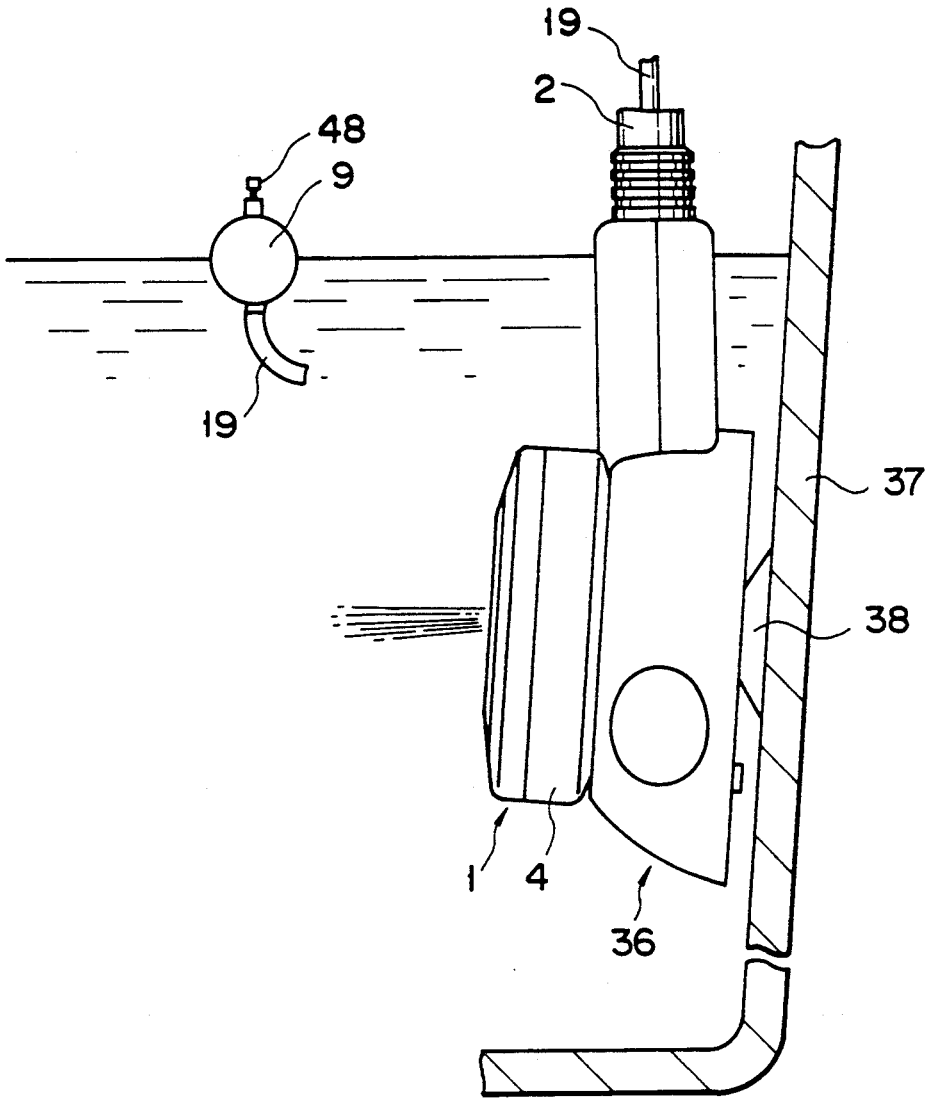
Figure 7:
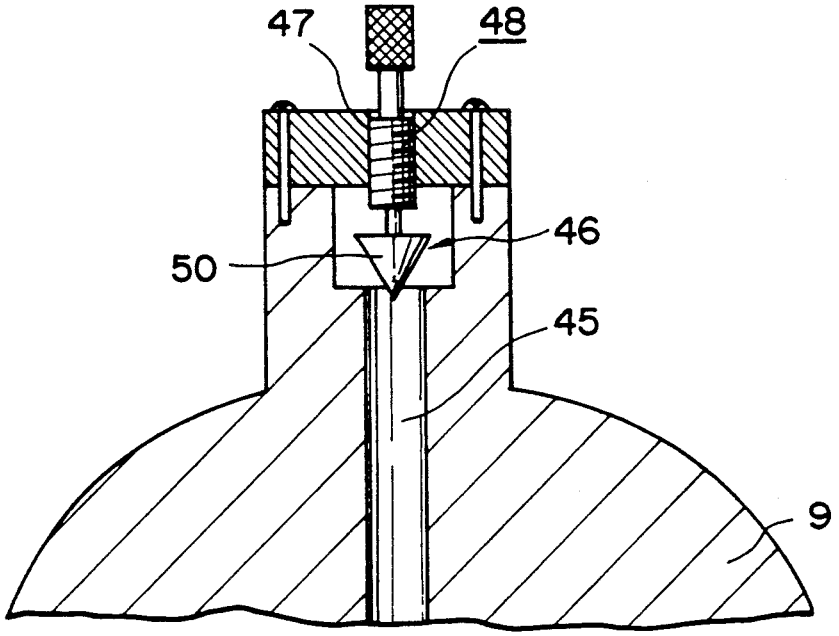
FIG. 7 is a view showing a detailed arrangement of an air amount adjusting means of a float.

One end of the air introducing hose 19 is fitted in the inlet of the air introducing hole 21. The other end of the hose 19 is fitted in a hose connecting portion of a float 9 floating on a hot water surface, as shown in FIG. 6. As shown in FIG. 7, an air introducing path 45 is formed inside the float 9 so as to take air from a bathroom and to introduce the air to the air introducing hose 19. An air amount adjusting means 46 is formed at the upper portion of the float 9 so as to adjust the amount of air to be introduced.

The adjusting means 46 comprises a screw hole 47 formed in the upper end of the float 9, a rotary shaft 48 which is threadably engaged with the screw hole 47 so as to be reciprocated, and a conical air valve 50 attached to the distal end of the rotary shaft 48. As the rotary shaft 48 threadably advances, the air valve 50 gradually closes the inlet of the air introducing path 45 so as to decrease the amount of air to be introduced. As the rotary shaft 48 rotates to move backward, the air valve 50 gradually opens the inlet of the path 45. By rotating the rotary shaft 48 in a desired direction so as to change the inlet path sectional area of the path 45 in this manner, the amount of air to be supplied to a jet stream can be arbitrarily adjusted.

The nozzle body 1 having the above-described arrangement can be fixed in a bath 37 by using a holder 36 with a suction disk 38 which is immersed and fixed in hot water in the bath 37, as shown in FIG. 6, or by mounting a suction disk on the rear surface of the nozzle case 4 of the nozzle body 1 and fixing the nozzle body 1 to the bath inner wall by the suction disk.

FIG. 1 shows a state wherein the outlet of the switching path 18 coincides with the flow path 22. In this state, a fluid mixture of hot water and air supplied from the hose 2 passes through the flow path 22 and enters the jet stream chamber 25. The fluid mixture then jets out from the jet hole 26 as a jet stream. At this time, air introduced from the float 9 to the air introducing hole 21 through the air introducing hose 19 is drawn into the jet stream chamber 25 by an ejector effect of the jet stream of the hot water, and hence the hot water and the drawn air are mixed with each other. The resultant fluid mixture is jetted out from the jet hole 26 as a jet stream. In this case, if the rotary shaft 48 is rotated to open/close the air valve 50, the amount of air to be mixed with hot the water is adjusted, and thus the pressure of the jet stream is changed in accordance with the adjusted air amount.

Since the float 9 is allowed to float on a corner of a hot water surface in the bath, i.e., a dead zone, a user can comfortably enjoy jet massage without being bothered by the float 9.

In addition, if the float 9 is kept floating on the hot water surface in the bath and air is introduced from the float 9, the air introducing hose 19 need not be extended around the bath. Hence, a user is not bothered by the hose 19, and the space around the bath can be kept in order. Therefore, the user can enjoy jet massage in a comfortable environment.

If the switching lever 20 is operated to match the outlet of the switching path 18 with a valve hole 35, the fluid mixture jets into the impeller chamber 14 through the path space 12, the through hole 30, and the paths 27 and 28, and this jet stream strikes against the vanes 29 to rotate the impeller 17. As the impeller 17 is rotated, the shield plates 34 sequentially seal the shower jet hole groups 33*a*, 33*b*, and 33*c*. When the shield plates 34 seal the hole groups 33*a* and 33*b*, shower jet streams jet out from the remaining hole group 33*c*. When the impeller 17 is further rotated and the shower jet hole groups 33*b* and 33*c* are sealed by the shield plates 34, shower jet streams jet out from the hole group 33*a*. In this manner, intermittent shower jet streams orderly jet out from the shower jet hole groups 33*a*, 33*b*, and 33*c* upon rotation of the impeller 17.

As described above, in this embodiment, by operating the switching lever 20, a jet jet massage by a jet, stream comprised of a mixture of air and water, or massage by intermittent jet water only streams can be selected as may be desired by the user.

Figure 8:
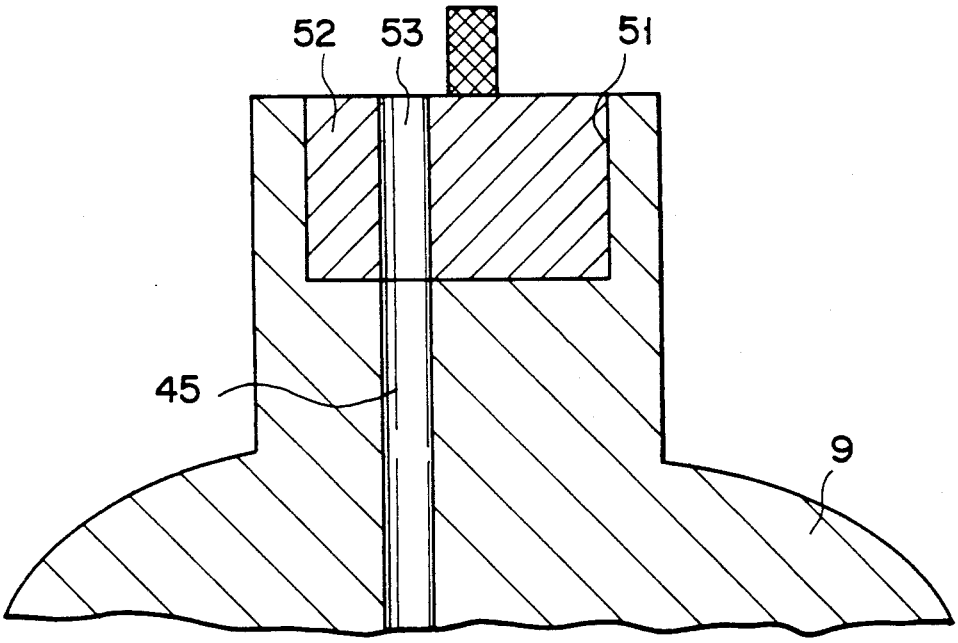
FIG. 8 is a view showing another air amount adjusting means.
Figure 9:
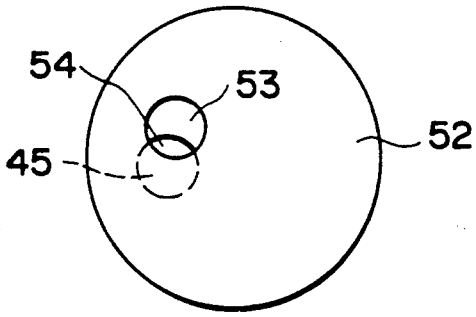
FIG. 9 is a view for explaining a function of the air amount adjusting means in FIG. 8.

Note that the present invention is not limited to above-described embodiments, and various changes and modifications can be made. For example, in the above embodiment, the air amount adjusting means 46 is constituted by the air valve 50. For example, as shown in FIG. 8, a shaft hole 51 is formed in the upper end of a float 9, and a rotary member 52 is fitted in the hole 51 so as not to be easily removed. An air hole 53 is formed in the rotary member 52 at a position radially deviated from its center. With this arrangement, the amount of air to be introduced can be adjusted by changing an area 54 where the air hole 53 overlaps an air introducing path 45, as shown in FIG. 9.

In addition, in the above embodiment, the jet hole 26 and the shower jet holes 32 are formed in the jet surface of the nozzle case so as to allow selective use of a jet stream, intermittent jet streams, and a shower. However, the shower jet holes 32 may be omitted to jet out only a jet stream. It is apparent that the apparatus of the present invention can be connected to a service water faucet.

Furthermore, intermittent jet streams are used as shower jet streams. However, the impeller 17 may be omitted to form continuous shower jet streams.

Moreover, in the above embodiment, the air introducing hose 19 is connected to the float 9. However, the float 9 may be omitted. In this case, the distal end of the hose 19 is fixed to a bathroom wall or the like, and air is introduced from the opening of the hose 19.

What is claimed is:

1. A jet nozzle apparatus comprising:

(a) a hose adapted to being connected a hot-water supply system;

(b) nozzle means including:

jet means defining at least one jet hole for forming a relatively high pressure jet stream of hot water supplied to said jet means through the hose;

means defining a plurality of shower holes in surrounding relationship to said jet hole defined by said jet means, each said shower hole for forming a relatively low pressure shower stream of hot water;

means defining a flow path for establishing fluid communication between the hose and each of said jet means and shower holes; and means defining an air-introducing hole for supplying air to the hot water immediately before the hot water is formed into said relatively high pressure jet stream by said jet means; and (c) change-over means for selectively switching the hot water flow from said hot water supply system through said defined flow path between said jet means and said plurality of shower holes, and wherein said air-introducing means includes an air hose having one end connected to said defined air-introducing hole for supplying air thereto.

2. A water jet-massage/shower apparatus comprising:

a body member having a water inlet end adapted to being coupled operatively to an available source of water, and an outlet end adapted to discharging water therefrom;

said body member defining at at said outlet end thereof a number of shower apertures for discharging water from said body member in a corresponding number of shower streams;

a jet nozzle positioned at said outlet end of said body member for forming a pressurized jet stream of water and for forcibly discharging said jet stream of water from said body member;

said body member including means defining a first flow path which establishes fluid communication between said available source of water and said jet nozzle, and a second flow path which establishes fluid communication between said available source of water and said number of shower apertures;

valve means associated with said body member and having first and second operative positions for respectively selectively changing flow of water within said body member between said first and second flow paths so as to respectively selectively cause said pressurized jet stream and said corresponding number of shower streams to be discharged from said outlet end of body member; and aspirating means defining an air-introduction path for introducing air downstream of said valve means into said first flow path defined within said body member, whereby said introduced air is mixed with said pressurized jet stream and discharged from said body member thereby, wherein said aspirating means includes:

(i) an air-introduction hole formed in said body member in fluid communication with said first flow path downstream of said valve means; and (ii) an air hose having one end connected to said air-introduction hole, and an opposite end that is open to ambient air.

3. An apparatus as in claim 2, wherein said aspirating means includes float means for floating on a surface of water and for supporting said opposite end of said air hose above said water surface.

4. An apparatus as in claim 3, wherein said float means includes air-introduction valve means for selectively varying amounts of air introduced into said air hose and to thereby controllably alter the pressure of said pressurized jet stream of water.

5. An apparatus as in claim 2 further comprising a suction cup for removably mounting said body member onto a surface of a plumbing fixture.

6. A water jet-massage/shower apparatus comprising:

a body member having a water inlet end adapted to being coupled operatively to an available source of water, and an outlet end adapted to discharging water therefrom;

said body member defining at at said outlet end thereof a number of shower apertures for discharging water from said body member in a corresponding number of shower streams;

a jet nozzle positioned at said outlet end of said body member for forming a pressurized jet stream of water and for forcibly discharging said jet stream of water from said body member;

said body member including means defining a first flow path which establishes fluid communication between said available source of water and said jet nozzle, and a second flow path which establishes fluid communication between said available source of water and said number of shower apertures;

valve means associated with said body member and having first and second operative positions for respectively selectively changing flow of water within said body member between said first and second flow paths so as to respectively selectively cause said pressurized jet stream and said corresponding number of shower streams to be discharged from said outlet end of body member; and aspirating means defining an air-introduction path for introducing air downstream of said valve means into said first flow path defined within said body member, whereby said introduced air is mixed with said pressurized jet stream and discharged from said body member thereby, wherein said first flow path defined in said body member includes an impeller chamber, and wherein said apparatus further comprises an impeller rotatably disposed within said impeller chamber for intermittently interrupting fluid communication between said available source of water and said number of shower apertures.

7. An apparatus as in claim 6, further comprising a suction cup for removably mounting said body member onto a surface of a plumbing fixture.

* * * * *